US006283211B1

(12) United States Patent
Vloedman

(10) Patent No.: US 6,283,211 B1
(45) Date of Patent: Sep. 4, 2001

(54) METHOD OF PATCHING DOWNHOLE CASING

(75) Inventor: Jack Vloedman, Midland, TX (US)

(73) Assignee: Polybore Services, Inc., Odessa, TX (US)

( * ) Notice: Subject to any disclaimer, the term of this patent is extended or adjusted under 35 U.S.C. 154(b) by 0 days.

(21) Appl. No.: 09/420,066

(22) Filed: Oct. 18, 1999

Related U.S. Application Data

(60) Provisional application No. 60/105,429, filed on Oct. 23, 1998.

(51) Int. Cl.[7] ..... E21B 29/10

(52) U.S. Cl. ..... 166/277; 166/77.1; 166/207

(58) Field of Search ..... 166/77.1, 77.2, 166/78.1, 277, 207, 118, 195, 196, 242.2, 242.8

(56) References Cited

U.S. PATENT DOCUMENTS

| | | | | |
|---|---|---|---|---|
| 3,354,955 | * | 11/1967 | Berry | 166/277 |
| 3,477,506 | * | 11/1969 | Malone | 166/207 |
| 3,691,624 | * | 9/1972 | Kinley | 29/523 |
| 4,441,561 | | 4/1984 | Garmong | 166/77 |
| 4,673,035 | | 6/1987 | Gipson | 166/77 |
| 4,971,152 | | 11/1990 | Koster et al. | 166/277 |
| 5,348,096 | | 9/1994 | Williams | 166/384 |
| 5,454,419 | | 10/1995 | Vloedman | 166/277 |

OTHER PUBLICATIONS

Article from "World Oil's Coiled Tubing Handbook", 1993; Part 1—The evolution of coiled tubing equipment.

Article from "World Oil's Coiled Tubing Handbook", 1993; Part 2—Workover safety.

Article from "World Oil's Coiled Tubing Handbook", 1993; Part 3—Tube Technology and capabilities.

Article from "World's Oil's Coiled Tubing Handbook", 1993; Part 9—Fishing.

"Large Diameter Coiled Plastic Tubing–Insertion in Casing for Flow" by Gary T. Ford, George E. King, and Jack A. Vloedman; SPE International; pp. 1–8, 1998.

"A Proven Techique for Econimic, In–Place Casing Lining and Repair" by George E. King, Jack Vloedman, Gary Ford, and Robert Westermark; SPE International; pp. 1–10, 1997.

* cited by examiner

*Primary Examiner*—William Neuder
*Assistant Examiner*—Zakiya Walker
(74) *Attorney, Agent, or Firm*—Dunlap, Codding & Rogers, P.C.

(57) ABSTRACT

A method for lining a portion of a casing affixed within a well bore a distance below an upper end of the well bore with a viscoelastic pipe having an upper end, a lower end, and an outer diameter greater than the inner diameter of the casing is provided. The outer diameter of the pipe is reduced so that the outer diameter of the pipe is less than the inner diameter of the casing. The reduced pipe is then lowered into the casing to a predetermined depth where the upper end of the reduced pipe is positioned a distance below the upper end of the well bore. The reduced pipe is then allowed to expand against the internal wall of the casing, thereby forming a fluid tight seal with the casing and effectively sealing any breaches in the casing. So that the outer diameter of the reduced pipe remains less than the inner diameter of the casing as the viscoelastic pipe is being passed down the casing, the reduced pipe is maintained in tension as the reduced pipe is being passed down the casing. Tension is maintained on the reduced pipe by suspending an amount of weight from the lower end of the pipe prior to passing the pipe down the casing. The amount of weight is sufficient to maintain the pipe in tension as it is being passed down the casing so that the outer diameter of the pipe remains less than the inner diameter of the casing as the pipe is being passed down the casing.

17 Claims, 9 Drawing Sheets

METHOD OF PATCHING DOWNHOLE CASING

CROSS-REFERENCE TO RELATED APPLICATIONS

This application claims the benefit of U.S. Provisional Application Ser. No. 60/105,429, filed Oct. 23, 1998, which is hereby incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to a method for sealing areas in a well bore, and more particularly, by not by way of limitation, to an improved method for inserting a tubular viscoelastic material into a casing affixed within a well bore for repairing breaches in the casing.

2. Description of Related Art

As the drilling of an oil or gas well progresses, the well bore is lined with a casing that is secured in place by a cement slurry injected between the exterior of the casing and the well bore. The casing functions to provide a permanent well bore of known diameter through which drilling, production or injection operations may be conducted. The casing also provides the structure for attaching surface equipment required to control and produce fluids from the well bore or for injecting fluids therein. In addition, the casing prevents the migration of fluids between subterranean formations through the well bore, i.e., the intrusion of water into oil or gas formations or the pollution of fresh water by oil, gas or salt water.

The mechanical integrity of the casing and the ability of the casing to isolate subterranean formations is closely regulated. Casing which has been cemented in a well bore is required to pass a mechanical integrity test to assure that no breaches in the casing occur. If the casing fails the mechanical integrity test, the casing must be repaired. Mechanical integrity failure can result from various means, such as corrosion, old perforations, or other breaches in the casing including joint leaks, split casing or parted casing.

Mechanical integrity failures are normally repaired by either replacing the defective casing, cementing a new casing inside the old casing, or injecting cement into the breach of the casing which is commonly known as "squeeze cementing". Replacement of defective casing is often not feasible because of the initial completion method used and the risk in damaging additional casing due to stress imparted on the casing during such an operation. Because the operation of inserting a new casing inside the old casing is expensive, this option may not be economically feasible. Additionally, squeeze cementing is not always economically feasible, and is inappropriate for certain types of subterranean formations. Furthermore, when squeeze cementing is utilized, satisfactory results are not always obtained. Finally, each of these remedies are costly in terms of the amount of time required for each operation, and therefore, the amount of time that the well is out of service.

To avoid the expense and time associated with the above-mentioned remedies, sealing apparatuses employing retrievable packers have been utilized for sealing and isolating casing at the point of the mechanical integrity failure. However, when employing such sealing apparatus, problems have been encountered. For example, the annular flow of fluids about a tubing string which extends through the sealing apparatus is often restricted, thus producing a hydraulic breaking effect as the apparatus is inserted into the well bore. Further, the annular flow may be restricted during mechanical integrity testing which requires an annulus between the tubing string and the casing. Lastly, the sealing apparatus is often ineffective because the resilient sealing elements become worn or deteriorate due to rough or, cement-coated interior casing walls when the sealing apparatus is inserted into the well bore.

A method of lining the casing with a continuous string of tubular viscoelastic material has also previously been proposed. This method is disclosed in U.S. Pat. No. 5,454,419, issued to Jack Vloedman, the present inventor. The method disclosed in the Vloedman '419 patent utilizes a continuous, seamless viscoelastic tubular liner wound on a portable spool. The liner, which has an outer diameter greater than the inner diameter of the casing, is reeled off the spool and through a roller reduction unit to reduce the diameter of the liner so that the liner can be injected into the casing. A weight system connected to the bottom end of the liner maintains the reduced liner in tension so that the liner remains in its reduced state until the liner is positioned at a desired depth. After the liner is run to such depth, the weights are removed thereby allowing the reduced liner to rebound and form a fluid tight seal with the casing and effectively sealing any breaches in the casing.

While the method disclosed in the Vloedman '419 patent has successfully met the need for repairing breaches in casing in an effective and time efficient manner, several inefficiencies have nevertheless been encountered, particularly in circumstances when only a selected segment of the casing is in need of repair. That is, if only a relatively short section of approximately 100 to 2000 feet of casing is in need of repair and this section is located several thousand feet below the surface, for example, it is more cost effective if the casing does not have to be lined entirely from the surface to the pertinent section. In addition, viscoelastic tubing has less tensile strength than conventional steel tubing. As such, in attempting to line the casing at depths below about 5,000 feet, the weight of the weight system coupled with the weight of the lining run into the casing can cause the lining to fatigue or even fail.

To this end, a need exists for an improved method for patching selected sections of casing with segments of viscoelastic tubing having a length less than the distance extending between the surface and a preselected depth to repair breaches therein which is durable and effective, while remaining inexpensive and time efficient. It is to such an improved method that the present invention is directed.

BRIEF SUMMARY OF THE INVENTION

The present invention is directed to a method for lining a portion of a casing affixed within a well bore a distance below an upper end of the well bore with a viscoelastic pipe having an upper end, a lower end, and an outer diameter greater than the inner diameter of the casing. The outer diameter of the pipe is reduced so that the outer diameter of the pipe is less than the inner diameter of the casing. The reduced pipe is then lowered into the casing to a predetermined depth where the upper end of the reduced pipe is positioned a distance below the upper end of the well bore. The reduced pipe is then allowed to expand against the internal wall of the casing.

So that the outer diameter of the reduced pipe remains less than the inner diameter of the casing as the viscoelastic pipe is being passed down the casing, the reduced pipe is maintained in tension as the reduced pipe is being passed down the casing. Tension is maintained on the reduced pipe by suspending an amount of weight from the lower end of the pipe prior to passing the pipe down the casing. The amount of weight is sufficient to maintain the pipe in tension as it is being passed down the casing so that the outer diameter of the pipe remains less than the inner diameter of the casing as the viscoelastic pipe is being passed down the casing.

The objects, features and advantages of the present invention will become apparent from the following detailed description when read in conjunction with the accompanying drawings and appended claims.

BRIEF DESCRIPTION OF THE SEVERAL VIEWS OF THE DRAWING

FIG. 6 is a diagrammatical illustration of the casing patch injector unit showing the casing patch being prepared to be lowered into the casing.

DETAILED DESCRIPTION OF THE INVENTION

Figure 1:
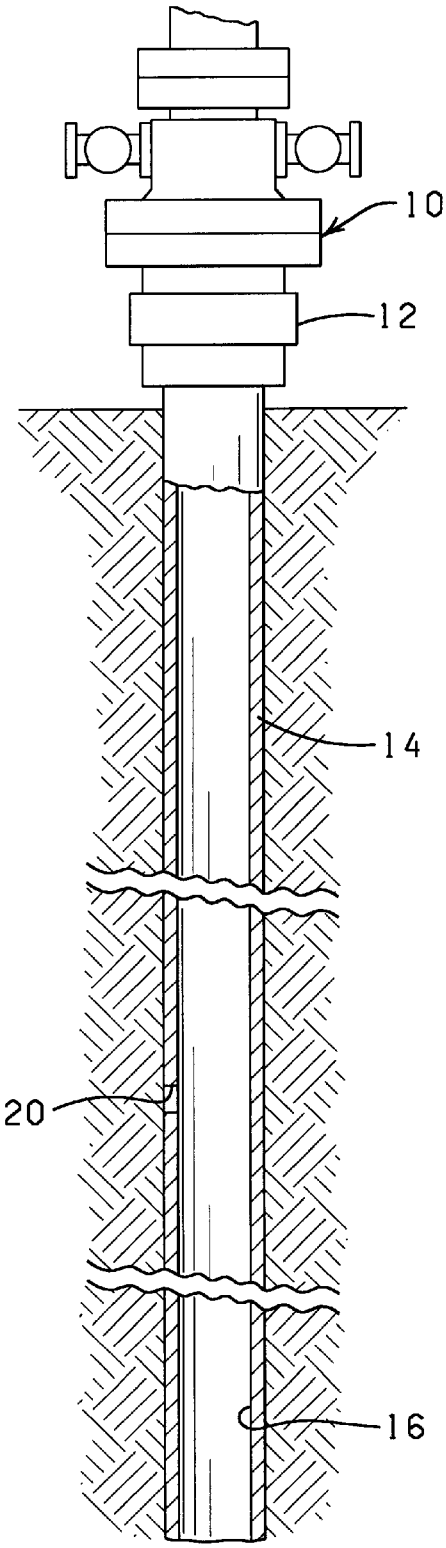
FIG. 1 is a cross sectional view of a well bore having a casing affixed therein showing the casing having a breach.

Referring now to the drawings, and more specifically to FIG. 1, a typical wellhead configuration 10 utilized in the production of oil and gas from a well is shown. The wellhead configuration 10 includes a casing head 12 which functions to support a casing 14 which is extended down the well to provide a permanent borehole through which production operations may be conducted. The casing 14 is shown affixed in a well bore 16 in a conventional manner, such as by cement (not shown). The casing 14 is illustrated as having a breach 20.

As mentioned above, the casing which lines an oil or gas well is intended to isolate subterranean formations to prevent the migration of fluids between various formations through the well bore. A breach in the casing provides a conduit between different formations and allows for the migration of fluids therebetween. The ability of fluids to migrate may result in fresh water formations being contaminated with hydrocarbons and salt water, hydrocarbons or injection fluids being lost to surrounding formations, or water flowing into the producing zone which substantially increases pumping and separating costs.

Current methods of repairing leaks in casing are either expensive or ineffective. As such, often the only option available to a well operator is to plug the leaking well thereby rendering it unusable for future production, injection, or disposal. Therefore, an effective and inexpensive method of repairing leaking casing is needed. Otherwise, leaking wells, unable to pass a mechanical integrity test, will continue to be plugged prematurely resulting in a shortage of production, injection and disposal wells.

Figure 2:
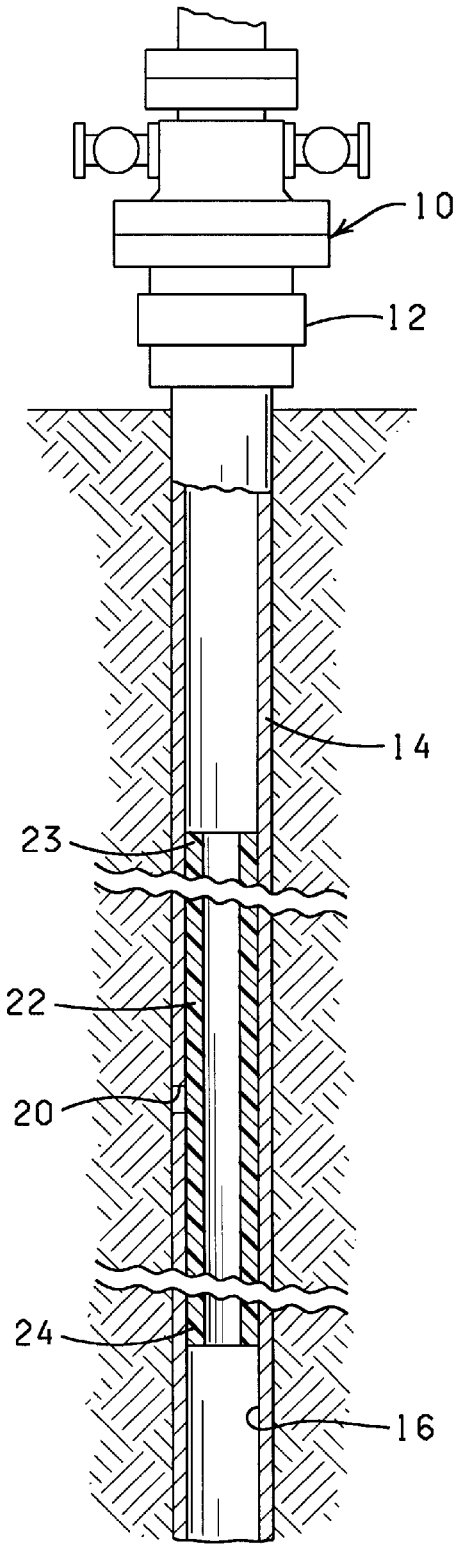
FIG. 2 is a cross sectional view of the well bore of FIG. 1 showing a casing patch of the present invention inserted into the casing.

FIG. 2 shows a casing patch 22 inserted in the casing 14 in accordance with the present invention wherein the breach 20 in the casing 14 is effectively sealed. The casing patch 22 is characterized as having an upper end 23 and a lower end 24. The unique aspect of the present invention is that the casing patch 22 is positioned in the casing 14 with the upper end 23 of the casing patch 22 positioned a distance below the casing head 12. The casing patch 22 is fabricated of a tubular viscoelastic material which is compressible and has sufficient memory so as to permit the material to return to its original shape after compression forces are removed from the material. More specifically, the tubular viscoelastic material is compressible in such a manner that the outer diameter of the tubular viscoelastic material can be substantially reduced in site and the memory of the material allows the material to rebound to its original size after a period of time. This capability of the diameter of the casing patch 22 to be downsized enables a tubular viscoelastic material having an outer diameter 25 (FIG. 4) greater than the inner diameter of the casing 14 to be injected into the casing 14. With the reduced tubular viscoelastic material positioned within the casing 14, the memory of the viscoelastic material causes the casing patch to expand within the casing 14 and press against the casing wall. Because the original outer diameter of the tubular viscoelastic material is greater than the inner diameter of the casing 14, the expanding tubular viscoelastic material presses tightly against the casing 14 and forms a fluid tight seal over the breach 20. To this end, the casing patch 22 is sealingly secured against the casing 14 without the use of adhesives which have generally proven to be ineffective in downhole environments.

A preferable material for the fabrication of the casing patch 22 is high density polyethylene pipe. In addition to the compression and memory characteristics mentioned above, polyethylene pipe is resistant to abrasion, which enables it to withstand the passage of downhole tools, and resistant to chemical and salt water corrosion. Furthermore, polyethylene pipe can be formed into a long, continuous joint containing no joint connections. This is important in that many casing leaks occur in or near the connection of one joint of casing to the adjacent joint of casing. By lining the casing 14 with a continuous joint of material, all casing joints are effectively sealed.

While polyethylene pipe is described herein as the material of preference for the fabrication of the casing patch 22 of the present invention, it will be recognized that the casing patch 22 is not limited to being fabricated of polyethylene. The casing patch 22 can be fabricated of any durable, viscoelastic material capable of withstanding temperatures and pressures typically encountered in oil and gas wells and which has compression and memory properties that allow it to be downsized for insertion into the casing and subsequently permit it to expand to form a fluid tight seal against the casing 14.

Figure 3:
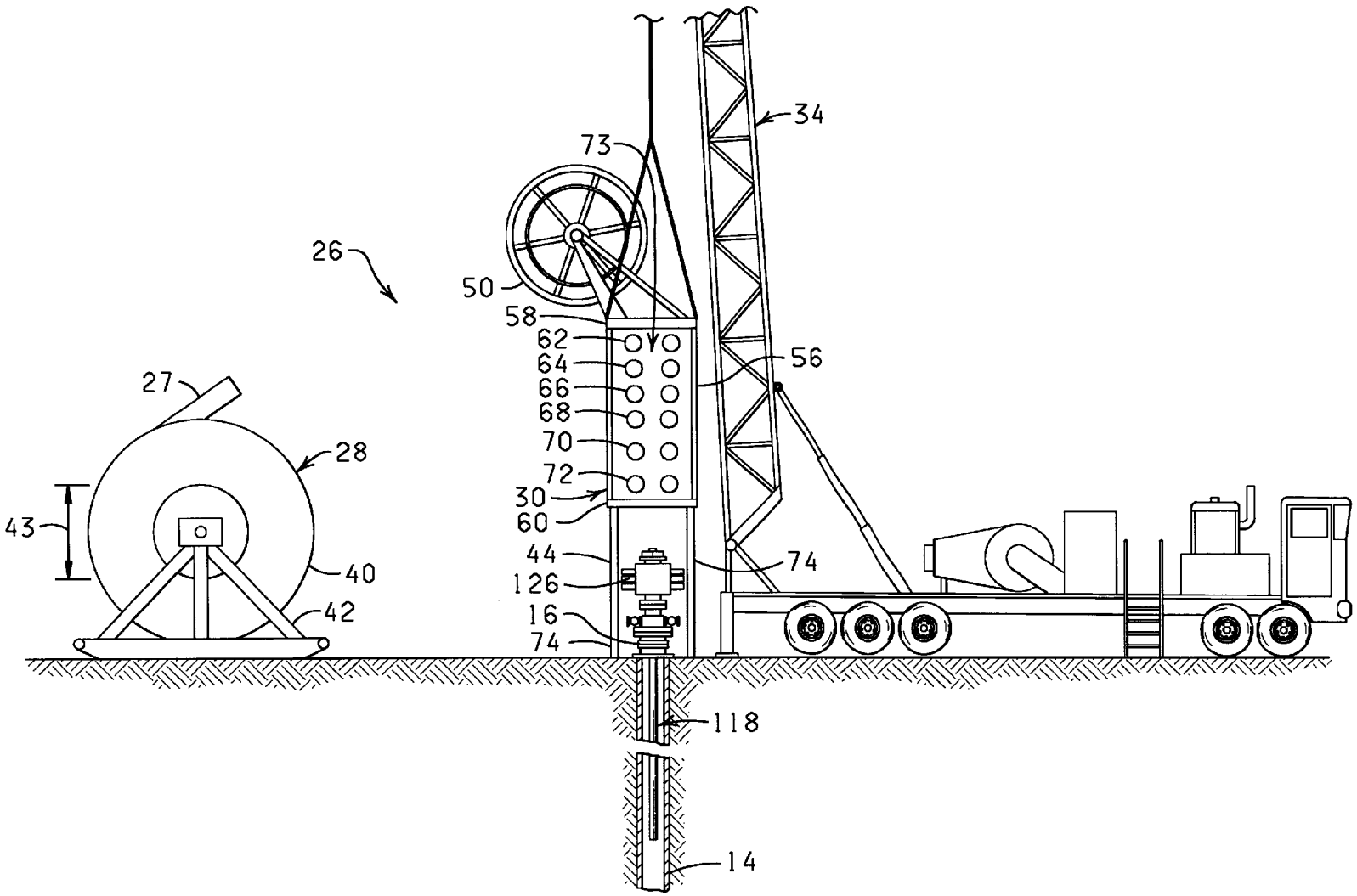
FIG. 3 is a diagrammatical illustration of a casing patch injector unit used in the method of the present invention.

Referring now to FIG. 3, a casing patch injector unit 26 constructed in accordance with the present invention for injecting a tubular viscoelastic material, such as a coiled polyethylene pipe 27, into the casing 14 to form the casing patch 22 (FIG. 2) is schematically illustrated. The casing patch injector unit 26 includes a reel 28 for handling and storing the polyethylene pipe 27 and a roller reduction unit 30 for directing the casing patch 22 into the casing 14, for reducing the diameter of the casing patch 22 to the desired diameter, and for partially injecting the reduced casing patch 22 into the casing 14. A conventional workover rig 34 is also utilized in the process of positioning the casing patch 22 in the casing 14.

The reel 28 comprises a spool 40 rotatably mounted to a frame 42. The frame 42 is set on a suitable support surface such as the ground (FIG. 3), a trailer, or offshore platform deck. The spool 40 has a core diameter 43 suitable for storing a polyethylene pipe of sufficient outer diameter to form a compression fit against the casing. For example, a casing having an outer diameter of 5.5 inches will have an inner, diameter of about 4.95 inches. As such, a polyethylene pipe having an outer diameter greater than 4.95 inches is required for the present invention, such as 5.25 inches, for example.

The roller reduction unit 30 is supported above the wellhead 10 by a support structure 44. The workover rig 34 is also connected to the roller reduction unit 30 so as to cooperate with the support structure 44 to support the roller reduction unit 30 above the wellhead 10. The connection of the workover rig 34 to the roller reduction unit 30 facilitates the rigging up and the rigging down of the roller reduction unit 30 by enabling the roller reduction unit 30 to be moved from a trailer (not shown) to its position over the wellhead 10 and back to the trailer once the injection process is completed.

The roller reduction unit 30 includes a guide wheel 50 and a support frame 56 having a first end 58 and a second end 60. The support frame 56 supports several banks of rollers 62, 64, 66, 68, 70, and 72 which are each journaled to the support frame 56. The rollers in each bank 62–72 are arranged to form a substantially circular passageway 73 through which the casing patch 22 is passed. Each subsequent bank of rollers 62–68 from the first end 58 to the second end 60 provides the passageway 73 with a diameter smaller than the diameter provided by the previous bank of rollers thereby cooperating to form a substantially frustoconically shaped passageway such that the outer diameter of the casing patch 22 will be gradually reduced as the casing patch 22 is passed therethrough. The banks of rollers 62–68 are preferably set up to reduce the outer diameter of the tubular viscoelastic material approximately 15%. The portion of the passageway 73 formed by the banks of rollers 70 and 72 provide the passageway 73 with a diameter that is the same size as the portion of the passageway 73 formed by the banks of roller 68 and thus the banks of rollers 68, 70, and 72 are adapted to frictionally engage the reduced casing patch 22 to provide the thrust to snub the reduced casing patch 22 into the casing 14 and to control the rate of entry into the casing 14.

To this end, each bank of rollers 62–72 is controlled by a hydraulic motor (not shown). The hydraulic motors are used to control insertion rate of the casing patch 22 into the casing 14 with respect to injection, as well as braking of the casing patch 22.

Roller reduction units as briefly described above are well known in the art. Thus, no further description of their components, construction, or operation is believed necessary in order for one skilled in the art to understand and implement the method of the present invention.

The roller reduction unit 30 is supported in an elevated position above the wellhead 10 with support structure 44 which can include a plurality of telescoping legs 74 or other suitable device such as a hydraulic jack stand. It should be noted that the roller reduction unit 30 should be elevated sufficiently above the wellhead 10 to permit access to the wellhead 10 during the casing patch injection process. As mentioned above, the roller reduction unit 30 is further supported by cables of the workover rig 34 which are connected to the first end 58 of the support frame 56 of the roller reduction unit 30.

As an example of an alternative to the roller reduction unit 30 described above, a roller reduction/wheel injector combination can be utilized to reduce and inject the casing patch 22 into the casing 14. Wheel injectors for injecting coiled tubing into a well bore, such as that described in U.S. Pat. No. 4,673,035, issued to Thomas C. Gipson on Jun. 16, 1987, the disclosure of which is hereby incorporated by reference, are well known in the art. When employing a wheel injector, the roller reduction unit is disposed between the reel 28 and the wheel injector which is adapted to receive the reduced casing patch 22 from the roller reduction unit. Like the roller reduction unit 30, the wheel injector provides the thrust to snub the reduced casing patch into the casing.

Figure 4:
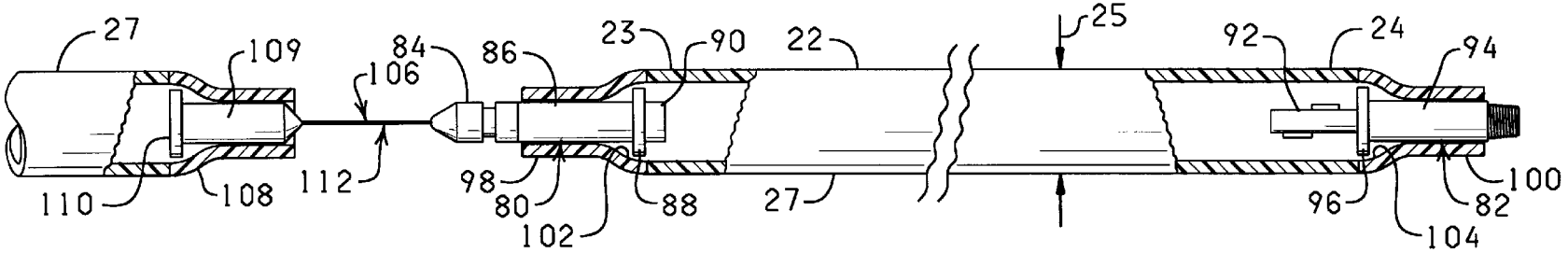
FIG. 4 is a partially cross sectional view of a casing patch constructed in accordance with the present invention shown attached to the end of a coil of viscoelastic pipe.

Reference is now made to FIG. 4 to illustrate the forming of the casing patch 22. Initially, a length of polyethylene pipe 27 is pulled off the spool 40 (FIG. 3) and cut to a selected length. It will be appreciated that the casing patch 22 can be formed to any length. However, by way of example only, the casing patch 22 may be cut to have a length in a range from about 100 to about 3,000 feet, depending on the number of breaches in the casing and their location. Upon cutting the casing patch 22 to length, an upper connector assembly 80 is positioned in the upper end 23 of the casing patch 22, and a lower connector assembly 82 is positioned in the lower end 24 of the casing patch 22. The upper connector assembly 80 includes the combination of an externally slotted member 84, a mandrel 86 with a flanged portion 88, and a retrieving tool 90. The lower connector assembly 82 includes the combination of an on/off tool 92, and a mandrel 94 with a flanged portion 96.

With the upper connector assembly 80 and the lower connector assembly 82 positioned in the respective ends of the casing patch 22, a guide shoe 98 is fused to the upper end 23 of the casing patch 22, and a guide shoe 100 is fused to the lower end 24 of the casing patch 22. Each of the guide shoes 98 and 100 is a tubular piece of viscoelastic material, preferably fabricated of the same material from which the casing patch 22 is fabricated, having one end with an outer diameter equal to the outer diameter of the casing patch 22 prior to reduction of the casing patch 22. Each guide shoe 98 and 100 is further provided with a tapered sidewall such that guide shoe 98 provides an internal support shoulder 102 when the guide shoe 98 is connected to the upper end 23 of the casing patch 22 and such that guide shoe 100 provides an internal support shoulder 104 when the guide shoe 100 is connected to the lower end 24 of the casing patch 22. The flanged portion 88 is dimensioned so that it will rest on the support shoulder 102 of the guide shoe 98 and not pass through the guide shoe 98. Likewise, the flanged portion 96 is dimensioned so that it will rest on the support shoulder 104 of the guide shoe 100 and not pass through the guide shoe 100.

A cable connector assembly 106 is positioned in the distal end of the polyethylene pipe 27 that remains on the spool 40 and a guide shoe 108, similar to the guide shoes 98 and 100 described above, is in turn fused to the distal end. The cable connector assembly 106 includes the combination of a mandrel 109 having a flanged portion 110, and a cable assembly 112. The cable assembly 112 has a short length of approximately 12 inches and is adapted to have one end threadingly connected to the mandrel 109 of the cable connector assembly 106 and the other end threadingly connected to the slotted member 84 of the upper connector assembly 80 so as to mechanically connect the casing patch 22 to the polyethylene pipe 27 of the spool 40, which functions as a carrier for the casing patch 22 during the reduction operation. With the casing patch 22 connected to the polyethylene pipe 27 via the cable assembly 112, the polyethylene pipe 27 and the casing patch 22 are wound back onto the reel 28.

Figure 5:
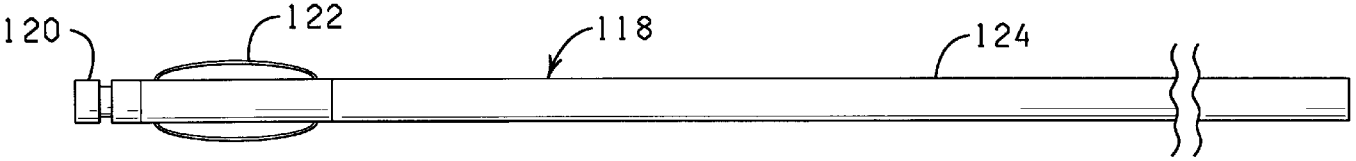
FIG. 5 is an elevational view of a weight assembly.
Figure 5:
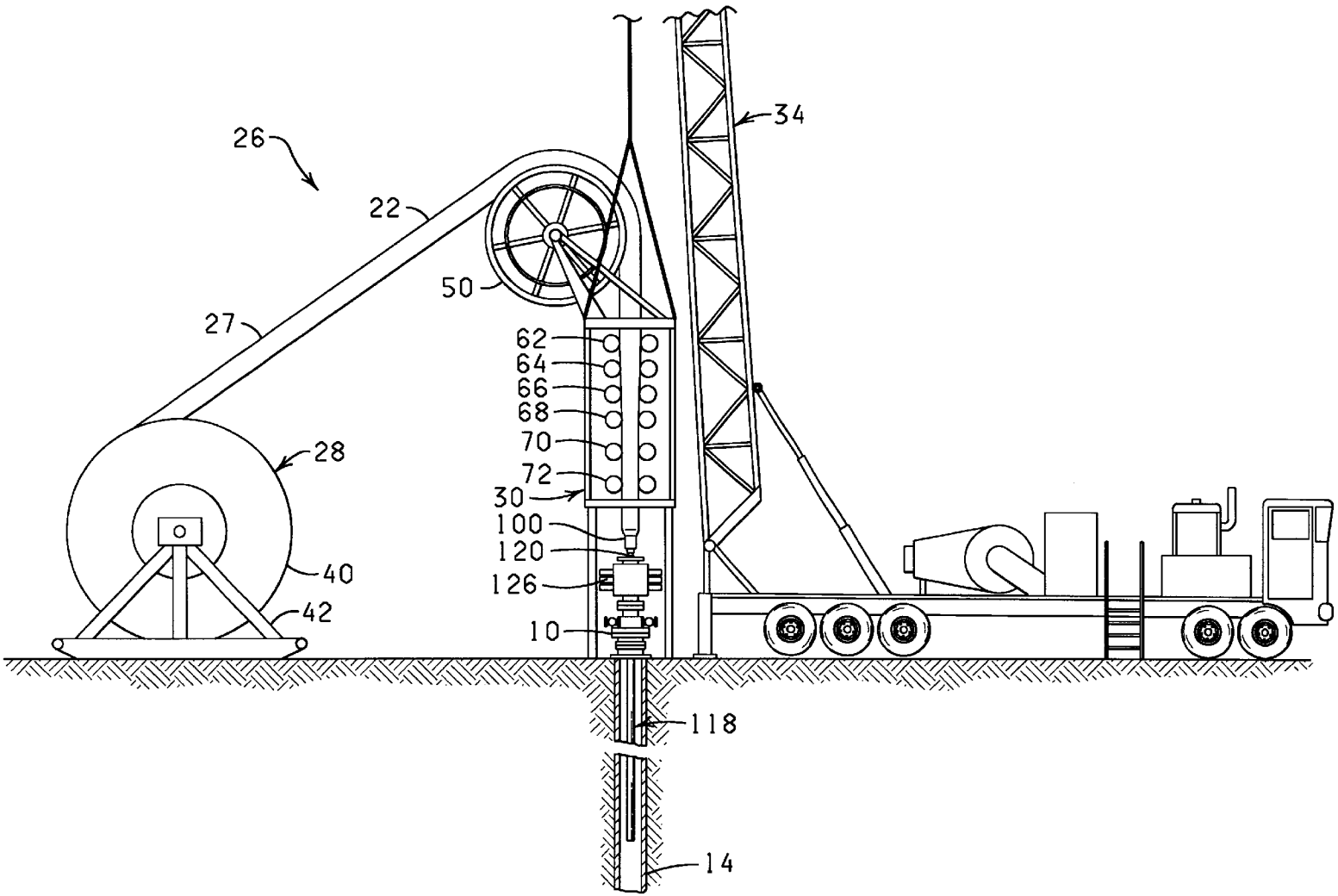

Prior to the casing patch 22 being positioned in the casing 14, the casing 14 is cleaned with a brush or scrapper to remove debris such as cement that may cause damage to the casing patch 22 or impede the insertion of the casing patch 22 into the casing 14. The well is then killed by injecting KCl or inserting a bridge plug or landing anchor 116 downhole (FIGS. 8A–8D). As shown in FIG. 3, a weight assembly 118 is then disposed and suspended in the upper portion of the well bore 16. As best shown in FIG. 5, the weight assembly 118 includes the combination of an externally slotted member 120 which is adapted to be threadingly connected to the mandrel 96 of the lower connector assembly 82, a string mill 122, and a series of weights which may be in the form of a plurality of drill collars 124 having sufficient weight for maintaining enough tension on the casing patch 22 to keep the casing patch 22 in a reduced state.

The weight assembly 118 can be suspended at the slotted member 120 from any convenient location, such as the wellhead 10 or from the top of a blow out preventer 126 (FIGS. 3, 6, and 7), if utilized, with a suitable device, such as a U-clamp (not shown) or a pair of slips (also not shown).

As illustrated in FIG. 6, the casing patch 22 is next fed over the guide wheel 50 and through the banks of rollers 62–72 of the roller reduction unit 30. When the guide shoe 100 has passed through the roller reduction injector unit 30 and is positioned near to the slotted member 120, as shown in FIG. 6, the mandrel 94 of the lower connector assembly 82 is threadingly connected to the slotted member 120, thereby connecting the lower connector assembly 82 to the weight assembly 118.

The lower connector assembly 82 is next caused to engage against the internal support shoulder 102 of the guide shoe 98 and place the reduced casing patch 22 in tension by reversing the roller reduction injector unit 30 so as to lift up on the weight assembly 118 so that the U-clamp or slips can be removed.

It is critical that the casing patch 22 remain in a reduced state as the casing patch 22 is being injected into the casing 14 and until the casing patch 22 is set at the desired depth. The lower connector assembly 82 and the weight assembly 118 cooperate to maintain the casing patch 22 in tension as the casing patch 22 is being lowered into the casing 14 in order to sustain the casing patch 22 in such reduced state. While the amount of weight needed to maintain the casing patch 22 in sufficient tension will vary depending on the size and composition of the pipe used to form the casing patch 22, the weight assembly 118 will typically require about 5,000 pounds of weight to maintain the casing patch 22 in sufficient tension.

Figure 7:
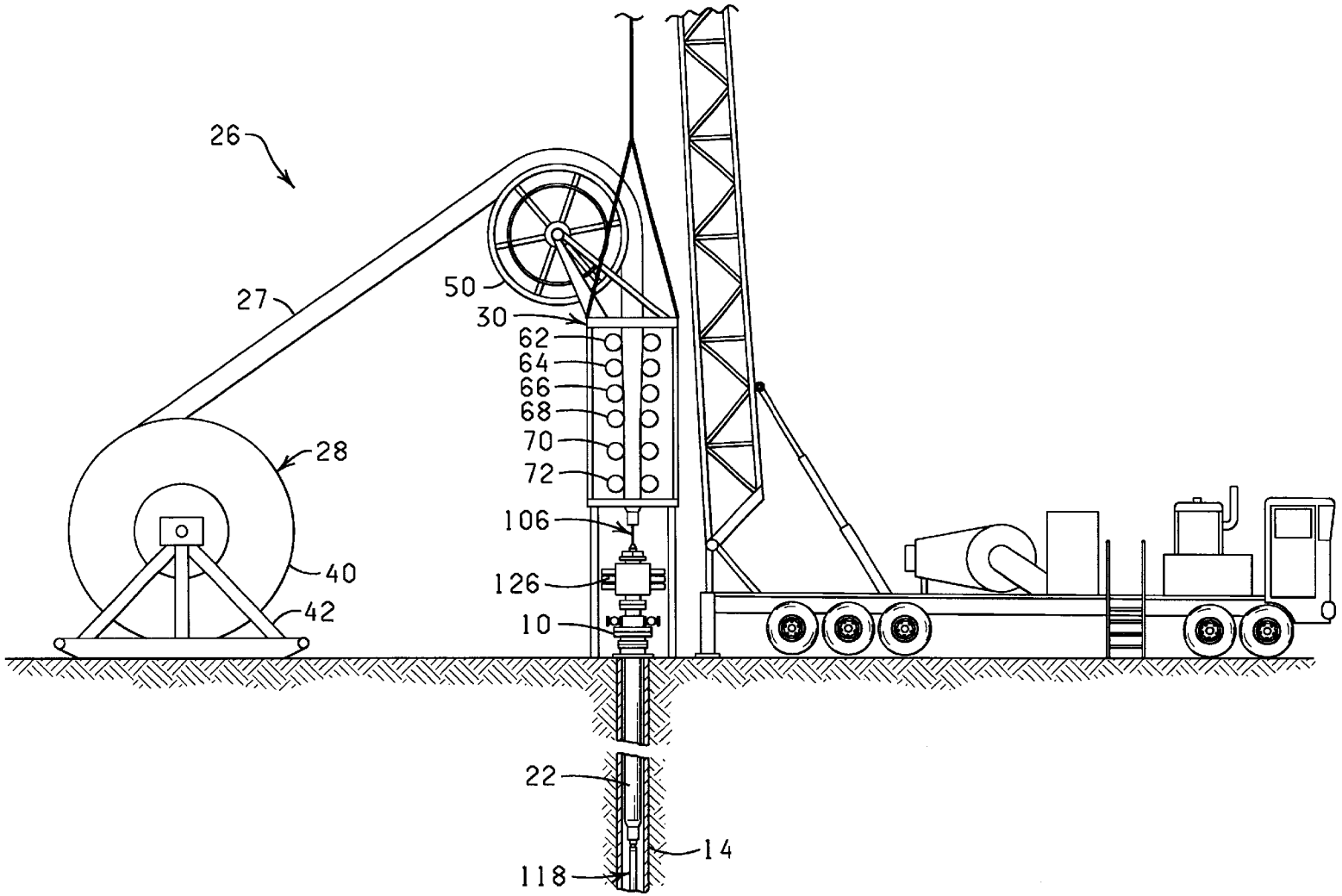
FIG. 7 is a diagrammatical illustration of the casing patch injector unit showing the casing patch lowered partially into the casing.

With the weight assembly 118 suspended from the lower end 24 of the casing patch 22, the roller reduction injector unit 30 is operated to lower the casing patch 22 into the casing 14 until the upper end 23 of the casing patch 22 is positioned near the top of the wellhead 10 or the blow out preventer 126, as illustrated in FIG. 7. The casing patch 22 is then suspended from the blow out preventer 126 or the wellhead 10 using the externally slotted member 84 of the upper connector assembly 80 and a U-clamp or slips. With the reduced casing patch 22 suspended in the wellbore 16, the cable assembly 112 is disconnected from the slotted member 84 and the roller reduction injector unit 30 and the polyethylene pipe 27 is removed from its position above the wellhead 10.

The floor (not shown) of the workover rig 34 is next lowered over the wellhead 10 and a work string 130 (FIG. 8A and 8B), which is made up to include a string mill 132 and a mandrel 134 at the lower end thereof, is threadingly connected to the slotted member 84 via the mandrel 134. The U-clamp or slips are then removed and the reduced diameter casing patch 22 is lowered down the casing 14 utilizing the work string 130 of the workover rig 34.

Figure 8A:
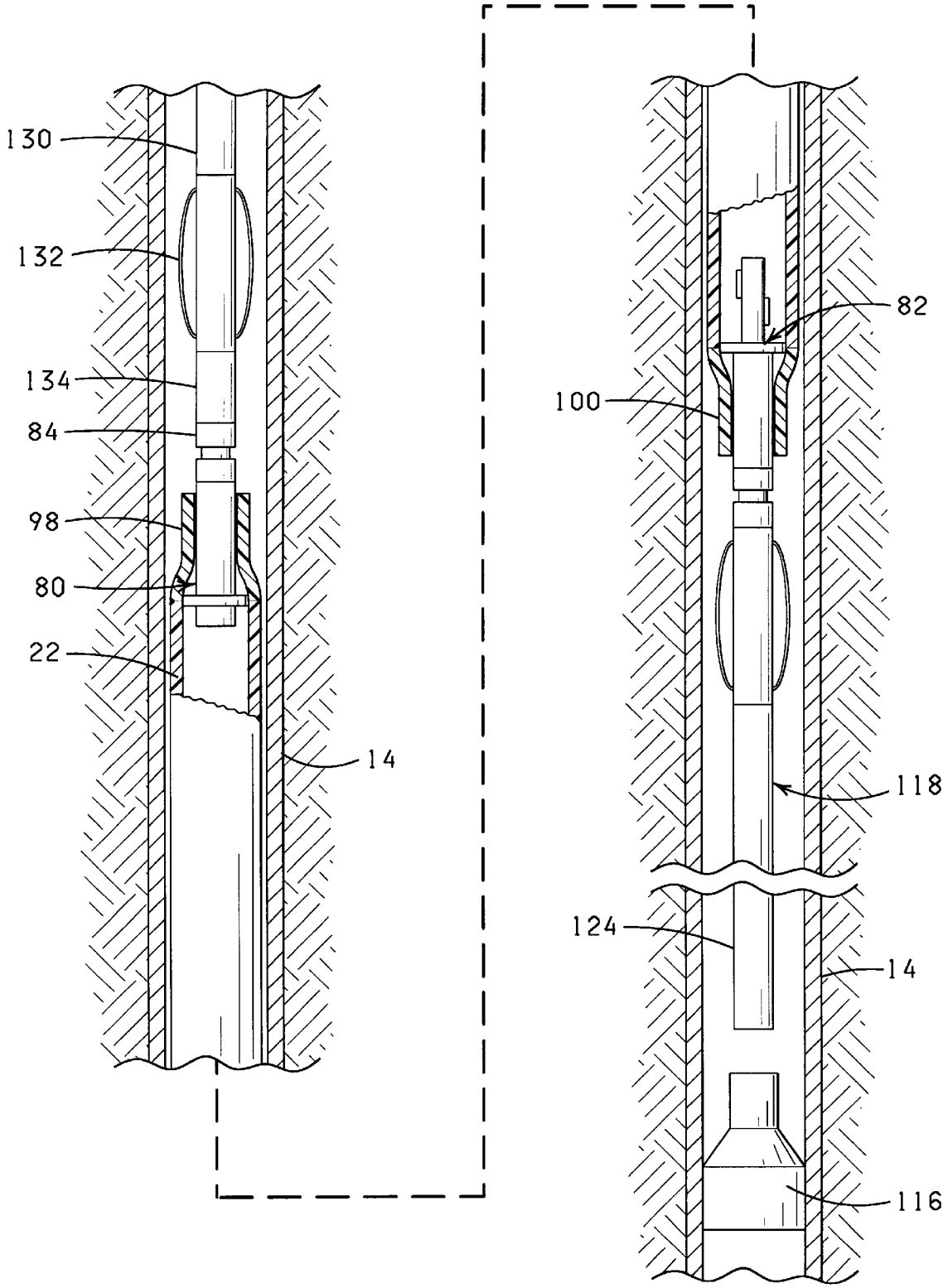
FIG. 8A is a partial cross sectional view of the casing patch showing the casing patch being lowered into the casing with a workstring and a weight assembly extending from the casing patch.
Figure 8B:
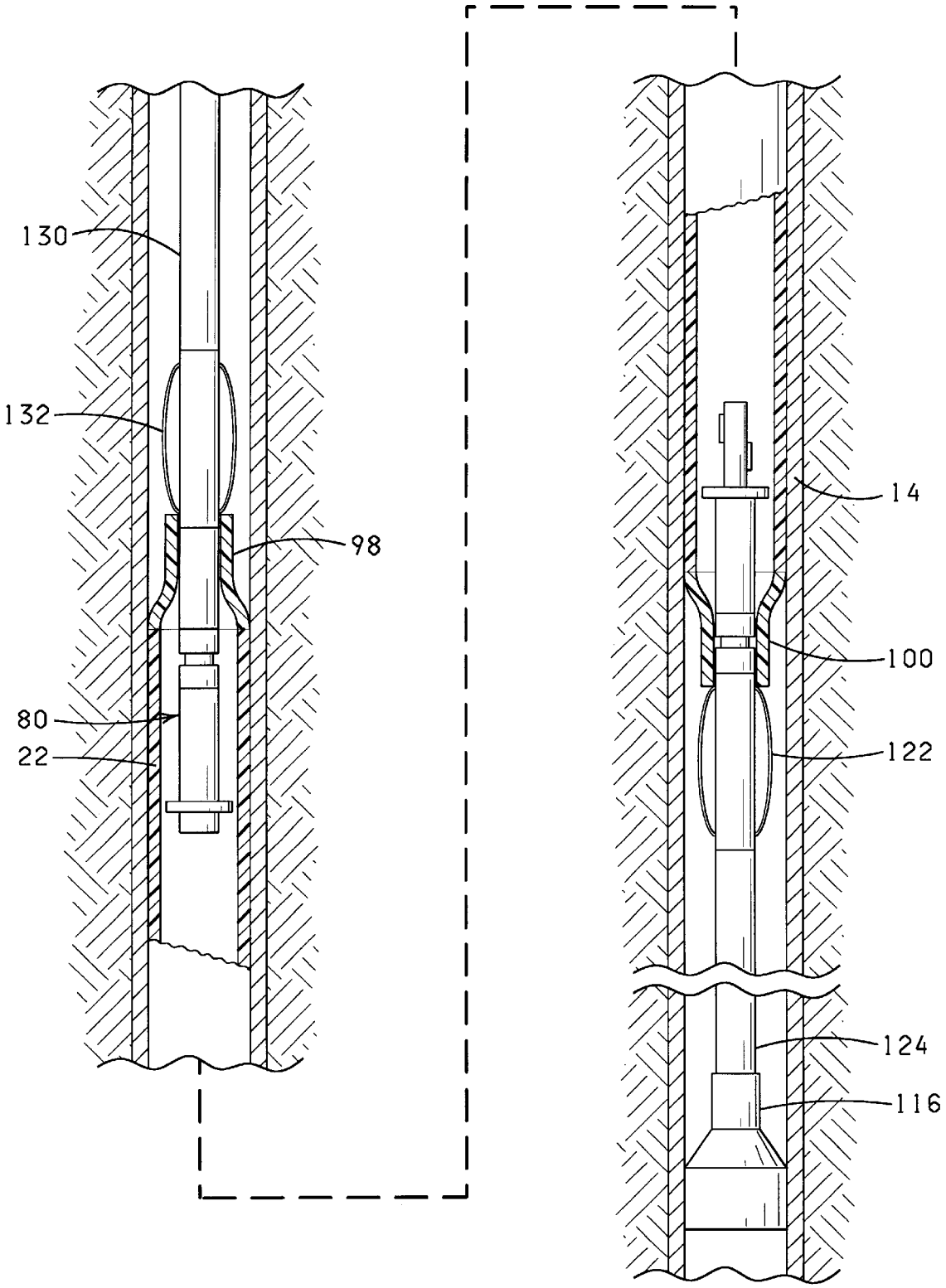
FIG. 8B is a partial dross sectional view of the casing patch showing the weight assembly landed on the landing anchor and the casing patch set against the casing.

The landing anchor 116 is set in the casing 14 at a depth which is below the desired setting depth of the casing patch 22 to account for the length of the string mill 122 and the drill collars 124 extending below the casing patch 22. Thus, as illustrated in FIG. 8B, the casing patch 22 is lowered into the casing 14 until the bottommost drill collar 124 sets down on the landing anchor 116 and the guide shoe 100 engages and rests on the string mill 122. The work string 130 and the upper connector assembly 80 are further lowered until the string mill 132 of the work string 130 engages and rests on the guide shoe 98.

With the weight of the weight assembly 118 supported on the landing anchor 116, the tension is removed from the casing patch 22. Consequently, the casing patch 22 is allowed to expand into position against the casing 14, as shown in FIG. 8B. To assist the expansion process, the weight of the work string 130 is maintained on the casing patch 22 for a period of time thereby causing the weight of the work string 130 to push the casing patch 22 out against the casing 14.

Figure 8C:
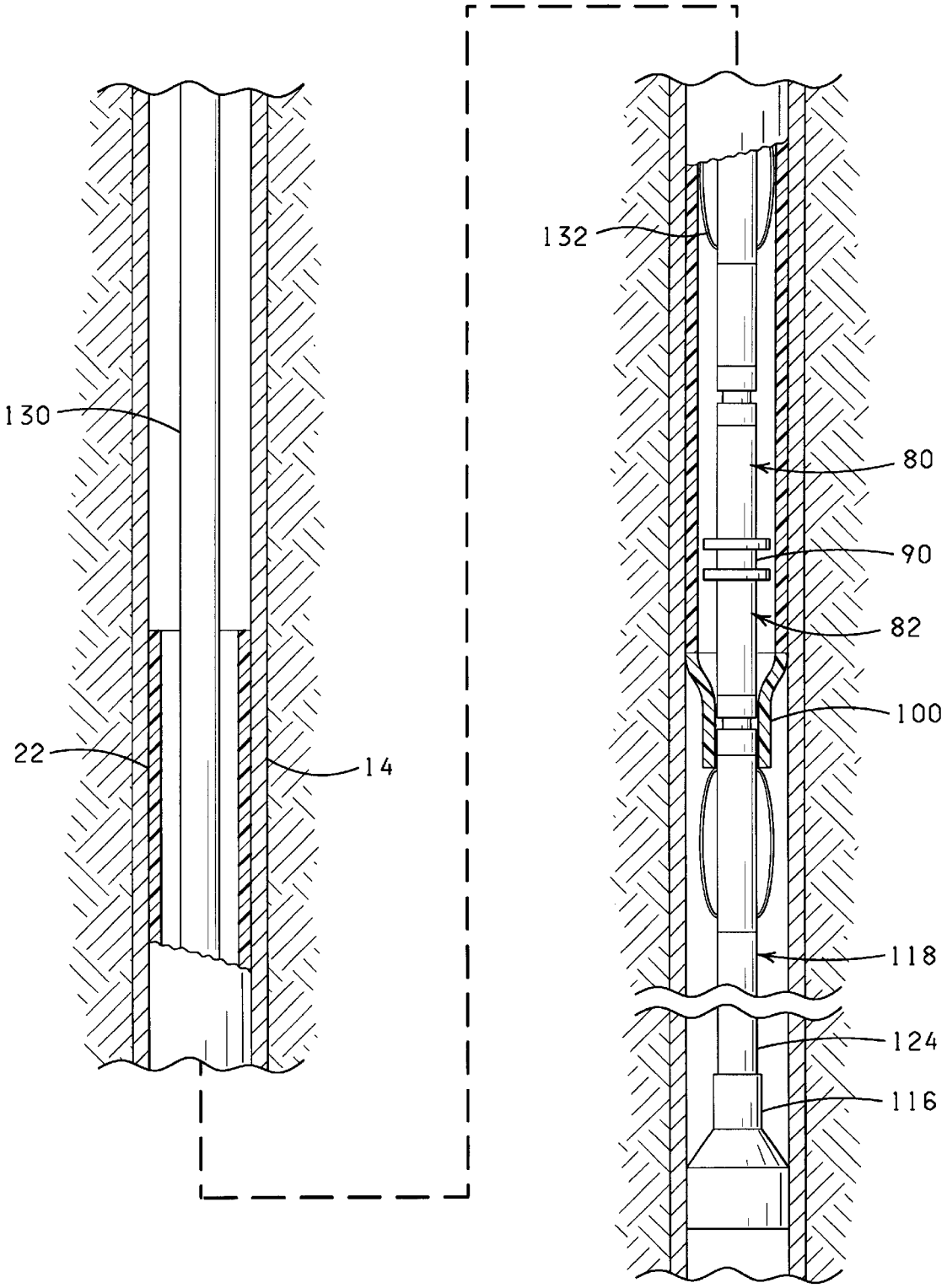
FIG. 8C is a partial cross sectional view of the casing patch showing the upper guide shoe of the casing patch having been milled out and the workstring having been connected to a bottom connector assembly and the weight assembly.
Figure 8D:
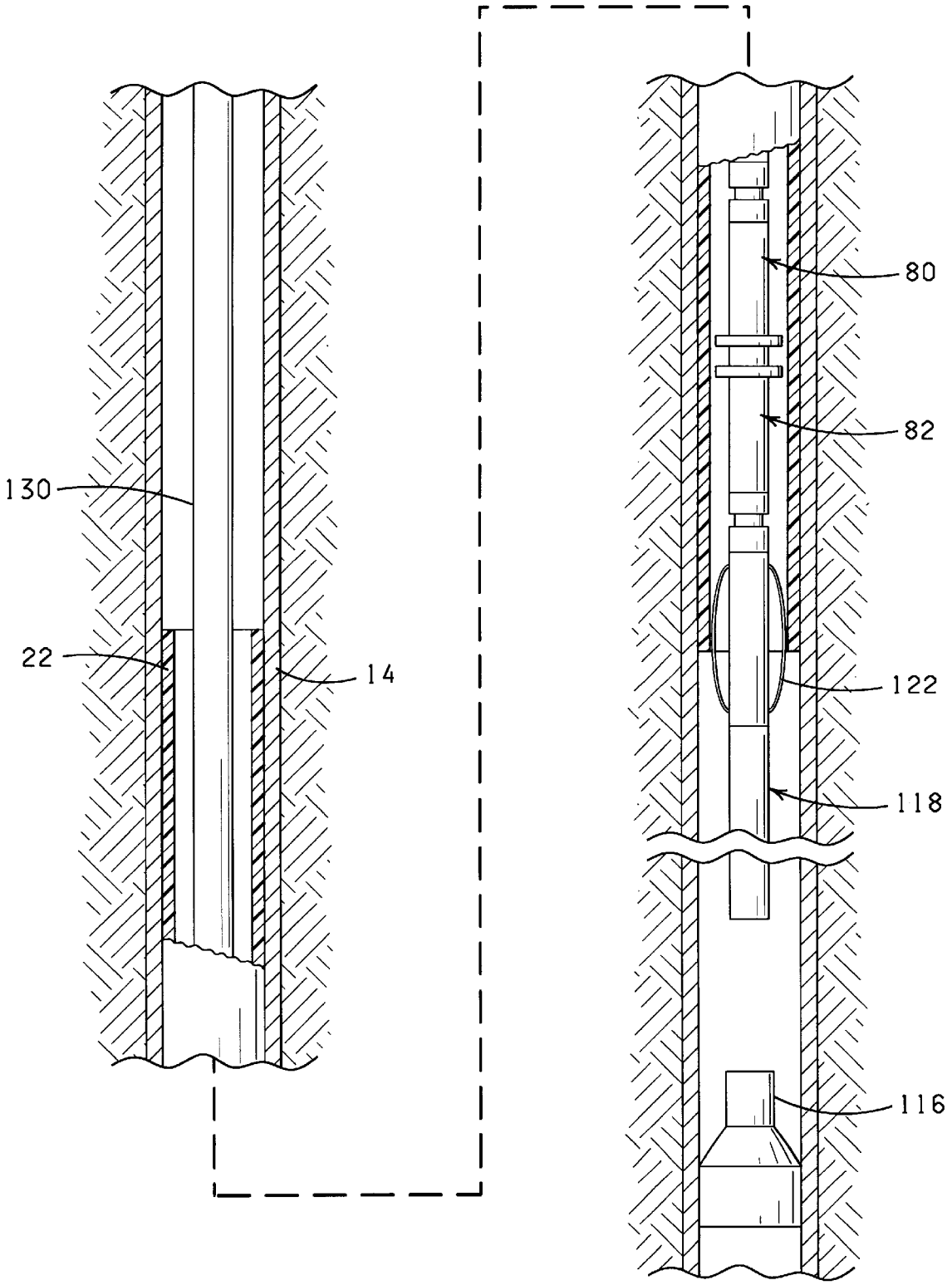
FIG. 8D is a partial cross sectional view of the casing patch showing the lower guide shoe of the casing patch having been milled out and the weight assembly in the process of being removed from the casing.

After the casing patch 22 has expanded into position against the casing 14, the work string 130 is rotated at the surface to cause the string mill 132 to mill out the guide shoe 98 to permit the work string 130 to be lowered through the casing patch 22 until the retrieving tool 90 of the upper connecting assembly 80 connects to the on/off tool 92 of the lower connector assembly 82 (FIG. 8C). At this juncture with the work string 130 connected to the lower connector assembly 82, and thus the weight assembly 118, the work string 130 is rotated and pulled up to mill out the guide shoe 100 with the mill string 122 (FIG. 8D). With the guide shoes 98 and 100 milled out, the work string 130 along with the upper connector assembly 80, the lower connector assembly 82, and the weight assembly 118 are pulled up through the casing patch 22 and removed from the well bore 16 leaving the casing patch 22 in-position against the casing 14 and effectively sealing any breaches therein.

In addition to enabling a patch having a predetermined length to be positioned along selective portions of a casing, the method of the present invention provides the further advantage of enabling a series of casing patches to be set in a casing whereby the entire length of a casing, which may be too great in length to be lined with a single casing patch, may be lined nevertheless.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A method for lining a portion of a casing affixed within a well bore a distance below an upper end of the well bore, the method comprising:

providing a viscoelastic pipe having an upper end, a lower end, and an outer diameter greater than the inner diameter of the casing;

reducing the outer diameter of the pipe so that the outer diameter of the pipe is less than the inner diameter of the casing, wherein the step of reducing the outer diameter of the pipe comprises:

disposing an upper connector assembly in the upper end of the viscoelastic pipe, the upper connector assembly having an outer diameter less than the inner diameter of the viscoelastic pipe;

connecting a guide shoe to the upper end of the viscoelastic pipe, the guide shoe having an inner diameter less than the inner diameter of the viscoelastic pipe such that a support shoulder is formed by the guide shoe;

linking the upper connector assembly to a carrier section of viscoelastic pipe;

passing the viscoelastic pipe and at least a portion of the carrier section of viscoelastic pipe through a roller reduction unit comprising a plurality of banks of rollers wherein the banks of rollers cooperate to form a substantially frusto-conically shaped passageway such that the outer diameter of the viscoelastic pipe is gradually reduced as the viscoelastic pipe is passed therethrough;

suspending the reduced viscoelastic pipe from the upper end of the well bore;

detaching the carrier section of viscoelastic pipe from the reduced viscoelastic pipe;

connecting a lower end of a work string to the upper connector assembly, the work string having an upper end connected to surface equipment and a string mill at the lower end thereof; and lowering the viscoelastic pipe into the casing with the work string;

passing the reduced viscoelastic pipe into the casing to a predetermined depth where the upper end of the reduced viscoelastic pipe is positioned a distance below the upper end of the well bore; and allowing the reduced viscoelastic pipe to expand against the internal wall of the casing.

2. The method of claim 1 further comprising the step of:

maintaining the reduced viscoelastic pipe in tension as reduced viscoelastic pipe is being passed down the casing so that the outer diameter of the viscoelastic pipe remains less than the inner diameter of the casing as the viscoelastic pipe is being passed down the casing.

3. The method of claim 2 wherein the step of maintaining the reduced viscoelastic pipe comprises:

suspending an amount of weight from the lower end of the viscoelastic pipe prior to passing same down the casing, the amount of weight being sufficient to maintain the viscoelastic pipe in tension as same is being passed down the casing so that the outer diameter of the viscoelastic pipe remains less than the inner diameter of the casing as the viscoelastic pipe is being passed down the casing.

4. The method of claim 3 wherein the step of suspending the amount of weight from the lower end of the viscoelastic pipe comprises:

disposing a connector assembly in the lower end of the viscoelastic pipe, the connector assembly having an outer diameter less than the inner diameter of the viscoelastic pipe;

connecting a guide shoe to the lower end of the viscoelastic pipe, the guide shoe having an inner diameter less than the inner diameter of the viscoelastic pipe such that a support shoulder is formed by the guide shoe; and connecting the amount of weight to the connector assembly such that the amount of weight is supported on the support shoulder of the guide shoe.

5. The method of claim 4 wherein the step of allowing the reduced viscoelastic pipe to expand comprises the step of removing the amount of weight from the guide shoe.

6. The method of claim 1 wherein the step of reducing the outer diameter of the viscoelastic pipe comprises the step of:

passing the viscoelastic pipe through a roller reduction unit comprising a plurality of banks of rollers wherein the banks of rollers cooperate to form a substantially frusto-conically shaped passageway such that the outer diameter of the viscoelastic pipe is gradually reduced as the viscoelastic pipe is passed therethrough.

7. The method of claim 1 wherein the step of reducing the outer diameter of the viscoelastic pipe comprises the step of:

passing the viscoelastic pipe through a roller reduction unit comprising a plurality of banks of rollers wherein the banks of rollers cooperate to form a substantially frusto-conically shaped passageway such that the outer diameter of the viscoelastic pipe is gradually reduced as the viscoelastic pipe is passed therethrough, each subsequent bank of rollers having a greater number of rollers than the previous bank of rollers to reduce trauma to the viscoelastic pipe thereby increasing the time the viscoelastic pipe remains in a reduced state.

8. A method for lining a portion of a casing affixed within a well bore a distance below an upper end of the well bore, the method comprising:

providing a viscoelastic pipe having an upper end, a lower end, and an outer diameter greater than the inner diameter of the casing;

reducing the outer diameter of the pipe so that the outer diameter of the pipe is less than the inner diameter of the casing, wherein the step of reducing the outer diameter of the pipe comprises:

disposing an upper connector assembly in the upper end of the viscoelastic pipe, the upper connector assembly having an outer diameter less than the inner diameter of the viscoelastic pipe;

connecting a guide shoe to the upper end of the viscoelastic pipe, the guide shoe having an inner diameter less than the inner diameter of the viscoelastic pipe such that a support shoulder is formed by the guide shoe;

linking the upper connector assembly to a carrier section of viscoelastic pipe;

passing the viscoelastic pipe and at least a portion of the carrier section of viscoelastic pipe through a roller reduction unit comprising a plurality of banks of rollers wherein the banks of rollers cooperate to form a substantially frusto-conically shaped passageway such that the outer diameter of the viscoelastic pipe is gradually reduced as the viscoelastic pipe is passed therethrough;

suspending the reduced viscoelastic pipe from the upper end of the well bore;

detaching the carrier section of viscoelastic pipe from the reduced viscoelastic pipe;

connecting a lower end of a work string to the upper connector assembly, the work string having an upper end connected to surface equipment and a string mill at the lower end thereof; and lowering the viscoelastic pipe into the casing with the work string;

loading the reduced viscoelastic pipe with an amount of weight so as to place the reduced viscoelastic pipe in sufficient tension so that the outer diameter of the reduced viscoelastic pipe remains less than the inner diameter of the casing;

passing the reduced pipe into the casing to a predetermined depth where the upper end of the reduced pipe is positioned a distance below the upper end of the well bore; and unloading the amount of weight from the reduced pipe thereby allowing the pipe to expand against the internal wall of the casing.

9. The method of claim 8 wherein the step of loading the pipe with an amount of weight comprises:

disposing a lower connector assembly in the lower end of the viscoelastic pipe, the lower connector assembly having an outer diameter less than the inner diameter of the viscoelastic pipe;

connecting a guide shoe to the lower end of the viscoelastic pipe, the guide shoe having an inner diameter less than the inner diameter of the viscoelastic pipe such that a support shoulder is formed by the guide shoe; and connecting the amount of weight to the lower connector assembly such that the amount of weight is supported on the support shoulder of the guide shoe.

10. The method of claim 9 wherein the step of allowing the reduced viscoelastic pipe to expand comprises the step of removing the amount of weight from the guide shoe.

11. The method of claim 10 wherein the amount of weight is provided by a weight assembly, and wherein the amount of weight is removed from the guide shoe upon the weight assembly setting down on a landing anchor positioned within the casing at a selected depth thereby removing the tension from the reduced viscoelastic pipe and allowing the viscoelastic pipe to expand against the internal wall of the casing.

12. The method of claim 11 wherein the upper connector assembly includes a retrieving tool, the lower connector assembly includes an on/off tool, and the weight assembly includes a string mill, and wherein the method further comprises:

rotating the work string to cause the string mill of the work string to mill out the upper guide shoe to permit the work string to be lowered through the viscoelastic pipe;

lowering the work string and the upper connector assembly through the viscoelastic pipe;

connecting the upper connector assembly to the lower connector assembly; and rotating and lifting the work string to cause the string mill of the weight assembly to mill out the lower guide shoe to permit the work string, the upper connector assembly, the lower connector assembly, and the weight assembly to be lifted through the viscoelastic pipe and removed from the well bore leaving the viscoelastic pipe in position against the casing.

13. The method of claim 11 wherein the weight assembly includes a string mill, and wherein the method further comprises:

rotating the weight assembly and thus the string mill to cause the string mill of the weight assembly to mill out the lower guide shoe to permit the weight assembly to be lifted through the viscoelastic pipe and removed from the well bore leaving the viscoelastic pipe in position against the casing.

14. A method for lining a portion of a casing affixed within a well bore a distance below an upper end of the well bore, the method comprising:

providing a viscoelastic pipe having an upper end, a lower end, and an outer diameter greater than the inner diameter of the casing;

reducing the outer diameter of the viscoelastic pipe so that the outer diameter of the viscoelastic pipe is less than the inner diameter of the casing, wherein the step of reducing the outer diameter of the viscoelastic pipe comprises:

suspending-the viscoelastic pipe from a carrier section of viscoelastic pipe;

passing the viscoelastic pipe and at least a portion of the carrier section of viscoelastic pipe through a roller reduction unit such that the outer diameter of the viscoelastic pipe is reduced as the viscoelastic pipe is passed therethrough;

suspending the reduced viscoelastic pipe from the upper end of the well bore;

detaching the carrier section of viscoelastic pipe from the reduced viscoelastic pipe; and suspending the reduced viscoelastic pipe from a lower end of a work string, the work string having an upper end connected to surface equipment;

passing the reduced viscoelastic pipe into the casing with the work string to a predetermined depth where the upper end of the reduced viscoelastic pipe is positioned a distance below the upper end of the well bore; and allowing the reduced viscoelastic pipe to expand against the internal wall of the casing.

15. The method of claim 14 wherein the step of suspending the viscoelastic pipe from the carrier section of viscoelastic pipe comprises:

disposing an upper connector assembly in the upper end of the viscoelastic pipe, the upper connector assembly having an outer diameter less than the inner diameter of the viscoelastic pipe;

connecting a guide shoe to the upper end of the viscoelastic pipe, the guide shoe having an inner diameter less than the inner diameter of the viscoelastic pipe such that a support shoulder is formed by the guide shoe on which a portion of the upper connector assembly is supportingly engageable; and linking the upper connector assembly to the carrier section of viscoelastic pipe such that the viscoelastic pipe is suspended from the carrier section of the viscoelastic pipe.

16. A method for lining a portion of a casing affixed within a well bore a distance below an upper end of the well bore, the method comprising:

providing a viscoelastic pipe having an upper end, a lower end, and an outer diameter greater than the inner diameter of the casing;

reducing the outer diameter of the viscoelastic pipe so that the outer diameter of the viscoelastic pipe is less than the inner diameter of the casing, wherein the step of reducing the outer diameter of the viscoelastic pipe comprises:

suspending the viscoelastic pipe from a carrier section of viscoelastic pipe;

passing the viscoelastic pipe and at least a portion of the carrier section of viscoelastic pipe through a roller reduction unit such that the outer diameter of the viscoelastic pipe is reduced as the viscoelastic pipe is passed therethrough;

suspending the reduced viscoelastic pipe from the upper end of the well bore;

detaching the carrier section of viscoelastic pipe from the reduced viscoelastic pipe; and suspending the reduced viscoelastic pipe from a lower end of a work string, the work string having an upper end connected to surface equipment;

loading the reduced viscoelastic pipe with an amount of weight so as to place the reduced viscoelastic pipe in sufficient tension so that the outer diameter of the reduced viscoelastic pipe remains less than the inner diameter of the casing;

passing the reduced viscoelastic pipe into the casing with the work string to a predetermined depth where the upper end of the reduced viscoelastic pipe is positioned a distance below the upper end of the well bore; and unloading the amount of weight from the reduced viscoelastic pipe thereby allowing the viscoelastic pipe to expand against the internal wall of the casing.

17. The method of claim 16 wherein the step of suspending the viscoelastic pipe from the carrier section of viscoelastic pipe comprises:

disposing an upper connector assembly in the upper end of the viscoelastic pipe, the upper connector assembly having an outer diameter less than the inner diameter of the viscoelastic pipe;

connecting a guide shoe to the upper end of the viscoelastic pipe, the guide shoe having an inner diameter less than the inner diameter of the viscoelastic pipe such that a support shoulder is formed by the guide shoe on which a portion of the upper connector assembly is supportingly engageable; and linking the upper connector assembly to the carrier section of viscoelastic pipe such that the viscoelastic pipe is suspended from the carrier section of the viscoelastic pipe.

* * * * *